US008166589B2

(12) United States Patent
Hijlkema

(10) Patent No.: US 8,166,589 B2
(45) Date of Patent: May 1, 2012

(54) MATTRESS

(75) Inventor: Bernardus Ludgerus Lubertus Hijlkema, Leeuwarden (NL)

(73) Assignee: B.V. Pijnloos, AJ Leeuwarden (NL)

( * ) Notice: Subject to any disclaimer, the term of this patent is extended or adjusted under 35 U.S.C. 154(b) by 715 days.

(21) Appl. No.: 12/226,897

(22) PCT Filed: May 3, 2007

(86) PCT No.: PCT/NL2007/000116

§ 371 (c)(1), (2), (4) Date: Jan. 23, 2009

(87) PCT Pub. No.: WO2007/126311

PCT Pub. Date: Nov. 8, 2007

(65) Prior Publication Data

US 2010/0031448 A1 Feb. 11, 2010

(30) Foreign Application Priority Data

May 3, 2006 (NL) ..... 1031743
Dec. 28, 2006 (NL) ..... 1033142

(51) Int. Cl.
*A47C 17/00* (2006.01)

(52) U.S. Cl. ..... 5/702; 5/710; 5/706; 5/913

(58) Field of Classification Search ..... 5/702, 690, 5/710, 706, 655.4, 689, 911, 913
See application file for complete search history.

(56) References Cited

U.S. PATENT DOCUMENTS 3,689,945 A 9/1972 Laerdal
5,826,583 A 10/1998 Wood

FOREIGN PATENT DOCUMENTS

FR 2 265 347 10/1975
WO WO 2004/098481 11/2004

*Primary Examiner* — Robert G. Santos
*Assistant Examiner* — Brittany Wilson
(74) *Attorney, Agent, or Firm* — Harness, Dickey & Pierce, P.L.C.

(57) ABSTRACT

An embodiment of the present invention discloses a mattress including an underlayer, an air chamber layer arranged above the underlayer, granular material incorporated in the air chamber layer, and adjusting devices for adjusting the amount of air in the air chamber layer between a rest position, wherein the granular material at least almost fills the whole air chamber layer, and an adjusting position wherein the air chamber layer is only partially filled with granular material.

15 Claims, 7 Drawing Sheets

MATTRESS

The invention relates to a mattress comprising an underlayer and an air chamber layer arranged above the underlayer, as known for instance from international patent application WO 2004/098481.

In this known mattress a quantity of granular material is incorporated in the underlayer. A vacuum can be created in the underlayer, whereby it becomes rigid after it has been brought into a desired form. The person lying on the mattress, in particular a patient but possibly also a healthy user, can hereby be properly supported at a desired position by the air chamber layer.

Although a patient or user can be well supported with the known mattress, for instance during a medical treatment, this known mattress is unsuitable for lying thereon for a long period because the person cannot change position easily.

The invention now has for its object to provide a mattress of the type described in the preamble of the main claim, wherein this problem is obviated.

For this purpose the mattress according to the invention as characterized in claim 1 comprises the measures, among others, that solid shaping material such as granular material is incorporated in the air chamber layer and adjusting means for adjusting the amount of air in the air chamber layer between a rest position, wherein the air chamber layer is substantially filled only with the solid shaping material, and an adjusting position wherein the air chamber layer is only partially filled with material and further with air under a pressure.

In the rest position a person lying on the mattress is supported uniformly well, while he/she can easily change position in the adjusting position. Once the person has changed position the adjusting means reset the rest position, whereby good support is once again obtained in the new position.

A very favourable further development of the mattress according to the invention is characterized in claim 2. The mattress also functions very well in this manner when the resting person is for instance asleep. When he/she starts to move in order to change position, the adjusting means feed a quantity of air into the air chamber layer, whereby the person can easily change position on a more rigid mattress. Once he/she has settled again, which is in turn detected by the movement detection means, the adjusting means then discharge the quantity of air from the air chamber layer, whereby the resting person is again well supported by the material in the air chamber layer, which as it were "shapes" itself below and to this person.

A further favourable development is characterized in claim 4. The power required to increase the amount of air in the air chamber layer is hereby limited, whereby the associated noise can also be limited.

A suitable embodiment of an air accumulator is characterized in claim 5.

Another embodiment of a suitable air accumulator is characterized in claim 7. The air pump need only have a small capacity because it can feed air to the air pocket for a longer period of time than is necessary for feeding the quantity of air into the air chamber layer from the rest position to the adjusting position.

A suitable material for the material comprises granular material, latex, foam (parts or flakes), polyether and/or expanded polystyrene granules and so on. Granules displace easily in the air chamber layer so that they can suitably take on an overall form corresponding to the part of the body of the person resting on the mattress which is in contact therewith. Good support, particularly in the rest state, can also be realized with materials other than the stated and other materials.

A suitable embodiment of the air chamber layer is characterized in claim 9.

In order to enable a good distribution of the granular material and the possibility of adjustment to the shape of the body, the measure of claim 10 is preferably applied.

A further suitable development of the mattress according to the invention, and in particular the air chamber layer, is characterized in claim 11. The blocks prevent tensile stresses occurring in the top layer which can be transferred to the body. These tensile stresses can cause discomfort to people who are extra-sensitive as a result of their disorder.

Claims 13 and 14 relate to favourable embodiments with a view to subdivision of a mattress according to the present invention.

The invention will be further elucidated in the following description with reference to the accompanying figures.

Figure 5A:
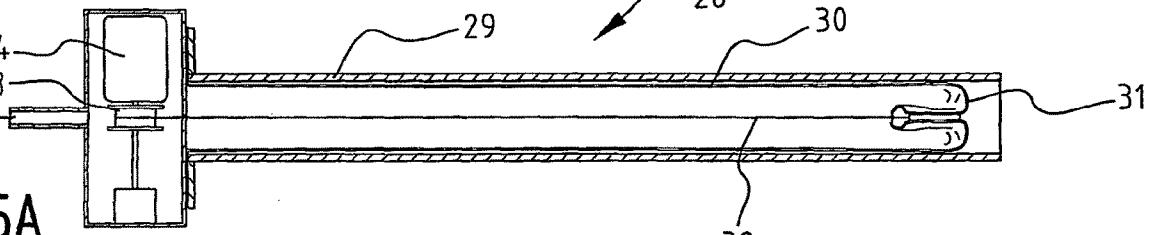

FIGS. 5A and B show two operating positions of an air accumulator.

Figure 6:
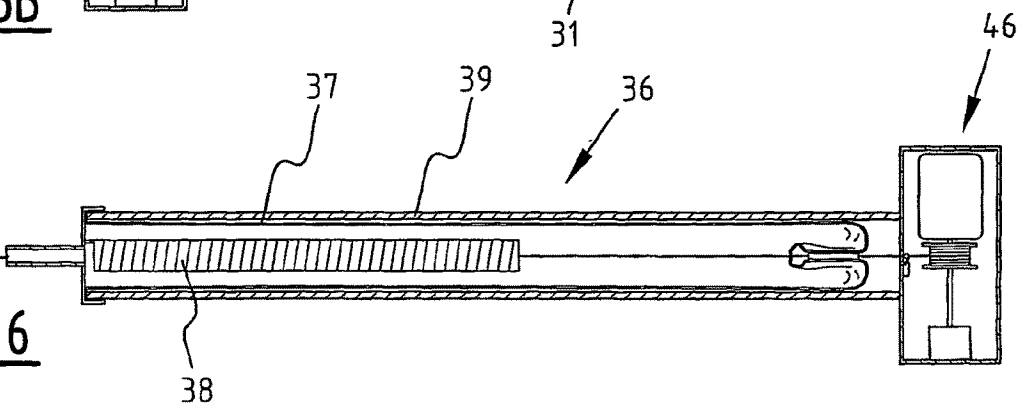

FIG. 6 shows a second embodiment of an air accumulator.

Figure 7:
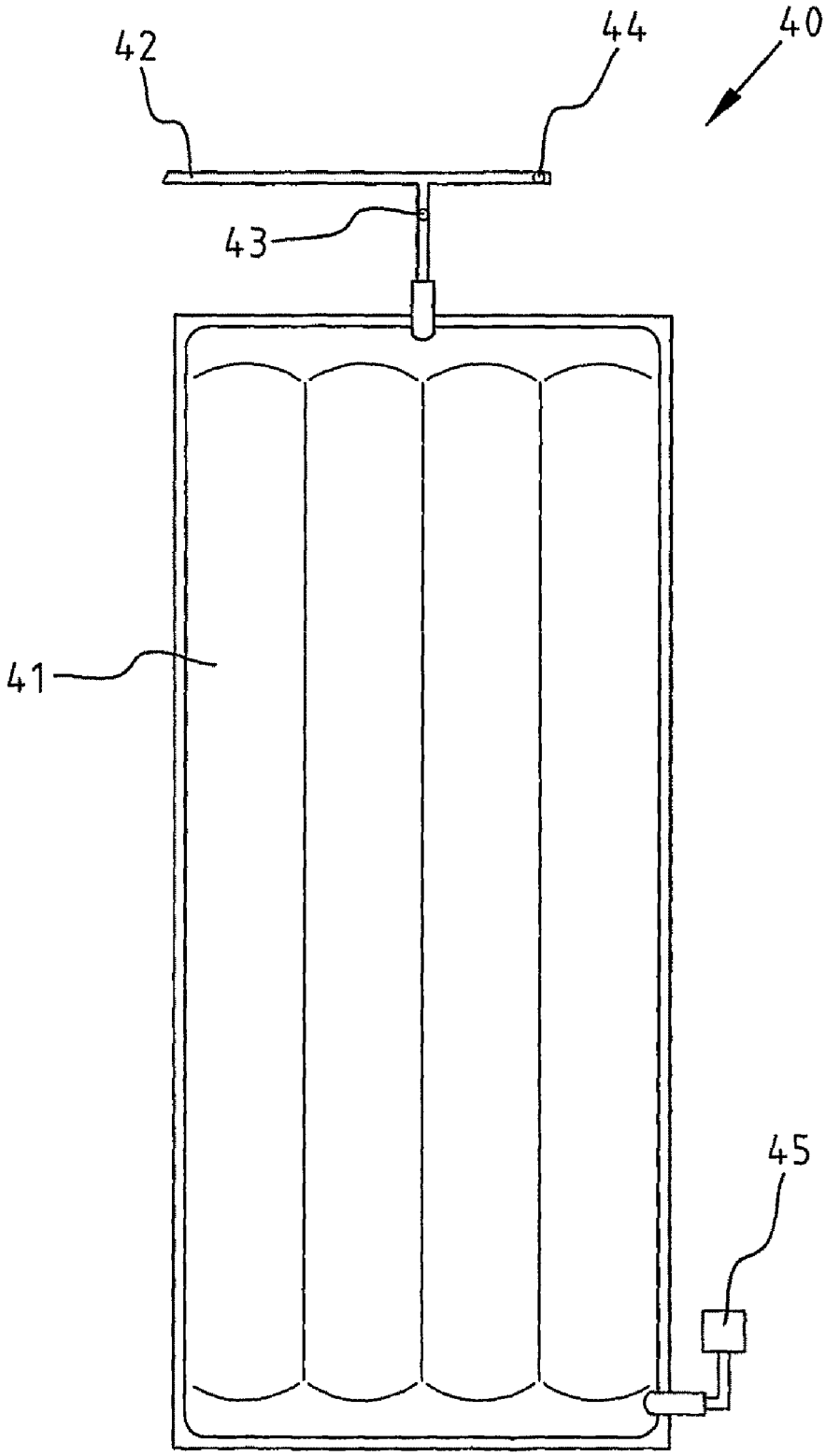

FIG. 7 shows a third embodiment of an air accumulator.

Figures 8, 9:
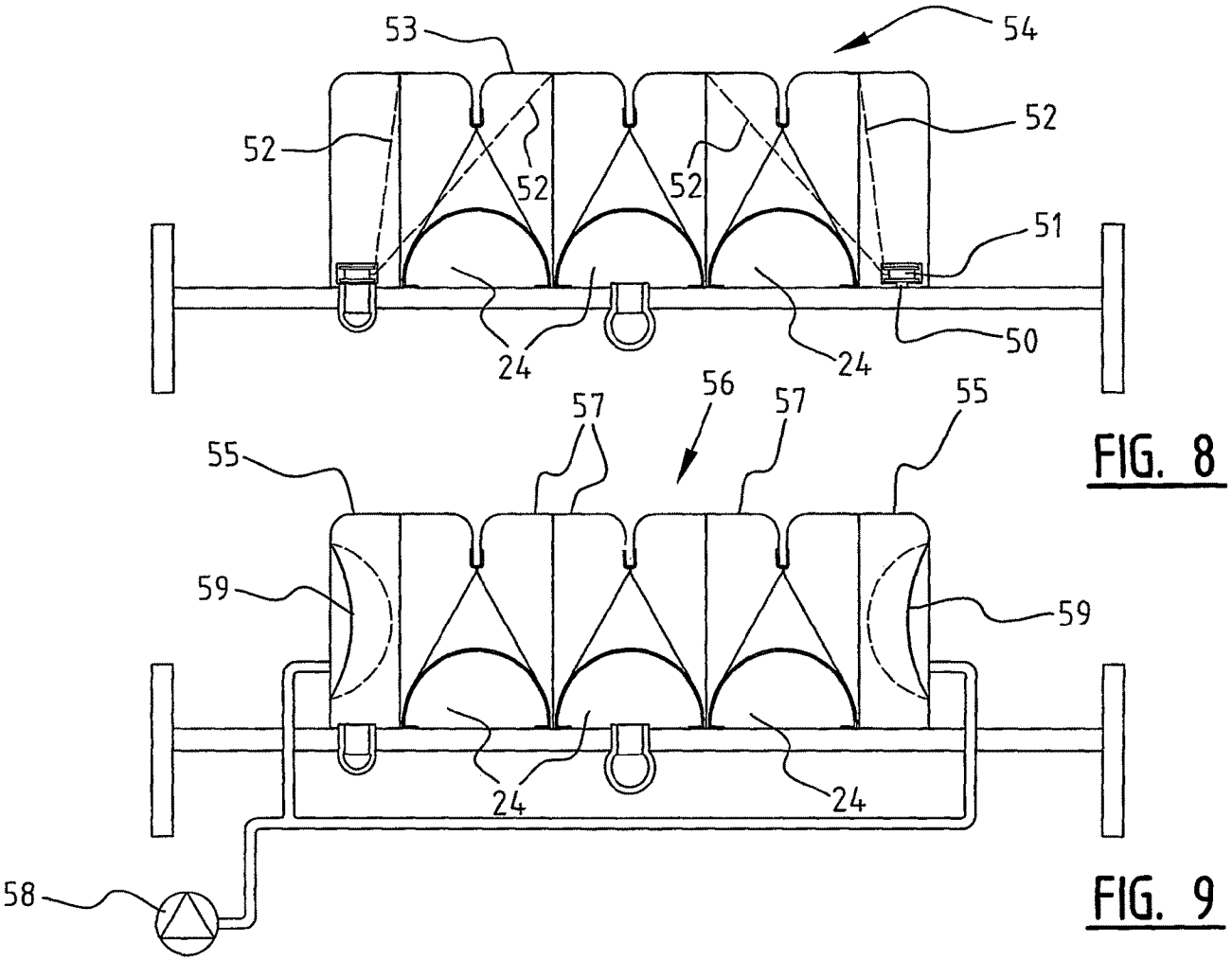

FIG. 8 shows a further embodiment of a mattress according to the invention.

FIG. 9 shows yet another embodiment.

Figure 10:
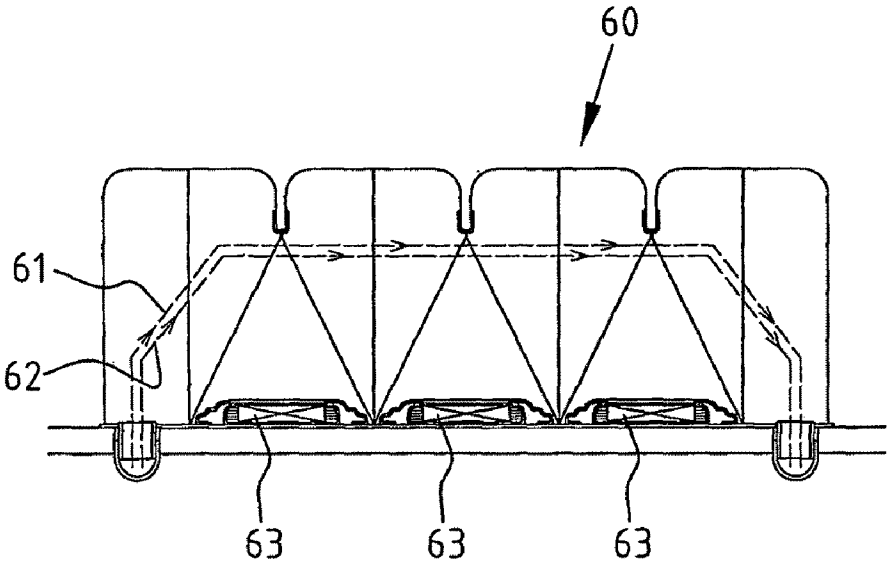
Figure 11:
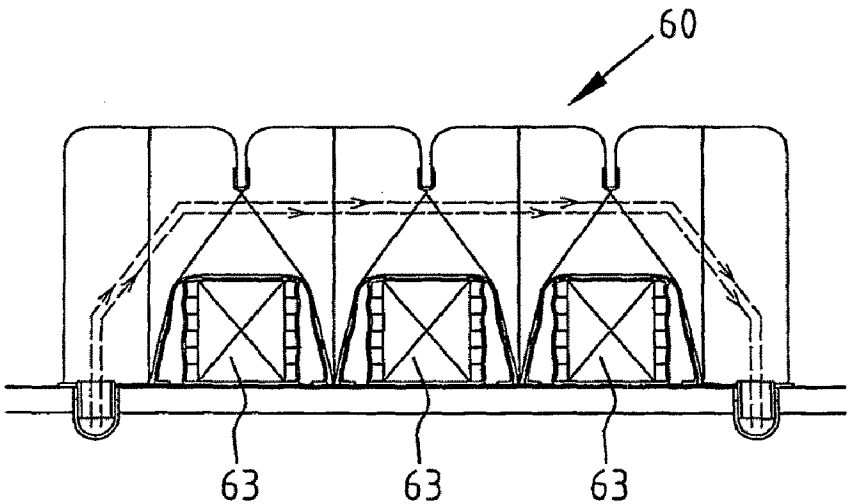

FIGS. 10 and 11 show another further embodiment of a mattress according to the present invention in two respective operating positions thereof.

FIG. 12 shows a further embodiment of a mattress according to the present invention.

In the various embodiments of the figures the same or similar components and parts can be designated with the same reference numerals. The description of a preferred embodiment will relate here to the use of granular material, although other materials can also be applied.

Figure 1A:
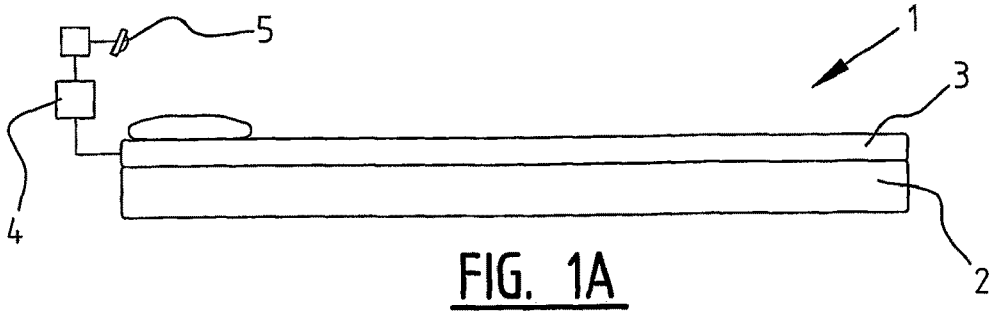
FIG. 1A is a schematic representation of a mattress according to the invention.

As shown schematically in FIG. 1A, a mattress according to the invention 1 comprises underlayer 2 and an air chamber layer 3 arranged above underlayer 2. As will become further apparent, granular material is present in this air chamber layer 3.

Mattress 1 further comprises adjusting means 4 for adjusting the amount of air in air chamber layer 3.

In the shown exemplary embodiment these adjusting means 4 comprise air transport means for feeding air to and discharging it from air chamber layer 3, and movement detection means 5 with associated control means which can activate the air transport means.

Figure 1B:
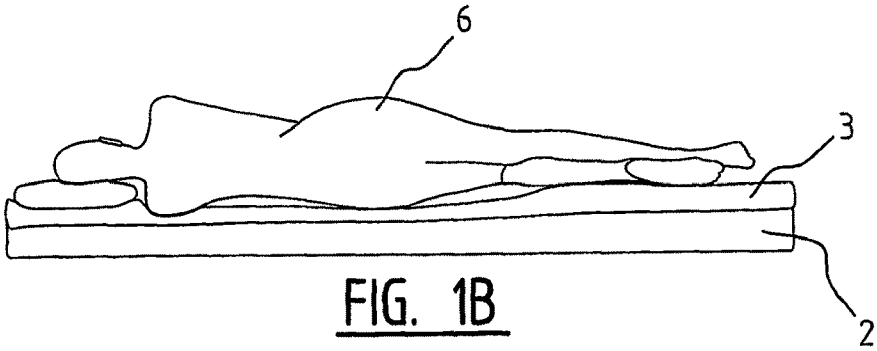
FIG. 1B shows the mattress according to the invention with the air chamber layer in the adjusting position.
Figure 1C:
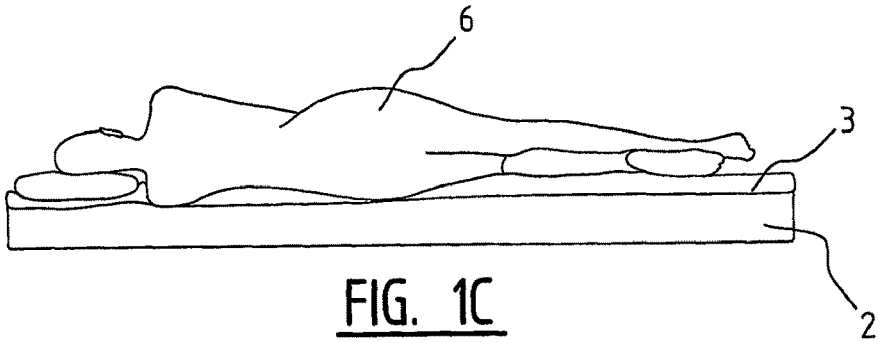
FIG. 1C is a view corresponding with FIG. 1B with the air chamber layer in the rest position.

Adjusting means 4, and more particularly the air transport means thereof, adjust the amount of air in chamber layer 3 between a rest position, as shown in FIG. 1C, and an adjusting position as shown in FIG. 1B.

In the adjusting position (FIG. 1B) there is a quantity of air in air chamber layer 3 such that the person 6 lying on the mattress can change position unhindered over a relatively hard or rigid mattress.

In the rest position (FIG. 1C) air chamber layer 3 contains less air, whereby person 6 is partially supported by the granular material in air chamber layer 3, which "shapes" itself to him or her.

When changing position and transposing from the adjusting position to the rest position the granular material will be displaced to "shape" itself to the person such that space is made free for the deepest-lying parts of person 6, and the space below the higher-lying parts of person 6 is filled with granules. When the rest position is then set, the "shape" of the granule bed is adapted to the person 6 lying in the related position.

Activation of the adjusting means can take place manually, but takes place according to a preferred embodiment in that these adjusting means comprise movement detection means 5 which, when detecting a movement of person 6, activate air transport means, whereby air is fed to air chamber layer 3. These detection means 5 can also be arranged in the mattress. When the movement has stopped the adjusting means can discharge air from air chamber layer 3 after a time, whereby the rest position is obtained.

The movement detection means can for instance comprise an infrared detector, or for instance pressure detection means, which can detect the pressure or pressure changes in or movements over or on air pressure chamber 3. When person 6 moves, the pressure in this air chamber layer will fluctuate, which is an indication of this movement.

In the rest position the mattress according to the invention provides a very good support of the person lying thereon. It is hereby highly suitable for people with chronic pain, for instance as a result of rheumatic disorders, fibromyalgia, back problems and the like. The mattress according to the invention is also highly suitable for bedridden people since it reduces, if not prevents, the risk of bedsores.

Although the mattress according to the invention provides very good support as a result of the granule layer adjusted to the shape of the lying person, the person can still change position easily because the person is substantially clear of the granules in the adjusting position. Upon return to the rest position the granule position adjusts to ("shapes" itself to) the shape of the prone person so that optimum support is once again provided in the new position.

Figure 2:
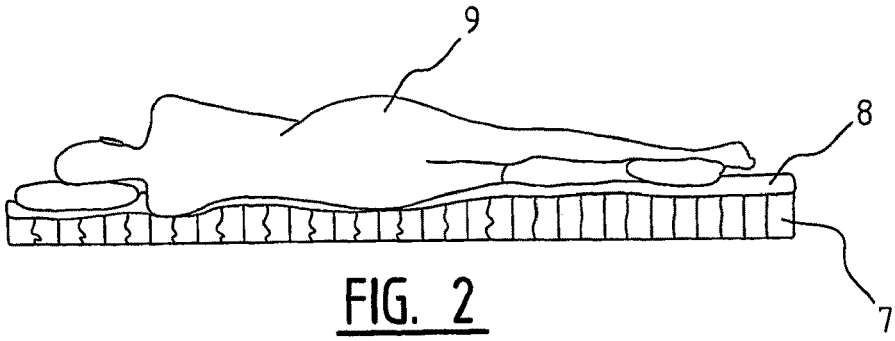
FIG. 2 is a view corresponding with FIG. 1C, wherein the mattress has a different underlayer.

Underlayer 2 can be a usual foam rubber layer, but according to a preferred embodiment as shown in FIG. 2 is an air mattress layer 7. The pressure in air mattress layer 7 can be adjusted in suitable manner so as to optimize the action of air chamber layer 8, so that the person 9 lying on the mattress is supported as well as possible and changes in position are impeded as little as possible.

Figure 3:
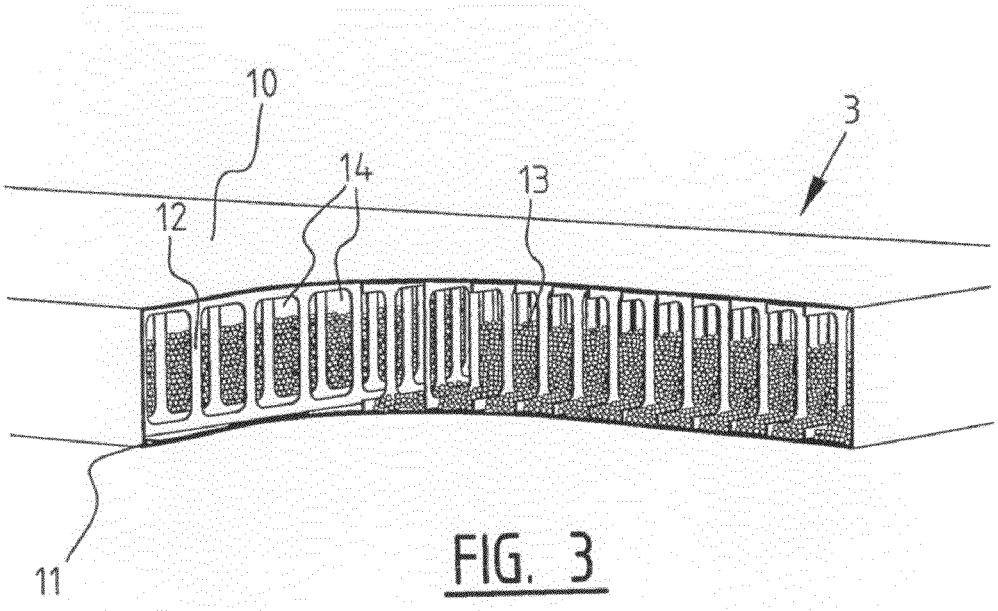
FIG. 3 shows a partly cross-sectional perspective view of a mattress according to a first embodiment of the invention.

According to a preferred embodiment as shown in FIG. 3, air chamber layer 3 comprises an upper foil 10 and a lower foil 11 which are connected airtightly to each other on their peripheral edges. Strips 12 are connected to upper foil 10 and lower foil 11 at regular distances, for instance by welding or glueing. Strips 12 ensure that upper foil 10 and lower foil 11 can remain substantially parallel to each other in the adjusting position and do not for instance begin to bulge. Strips 12 are provided with large openings 14 for passage of granular material 13. This granular material can readily spread through the interior of the air chamber layer through openings 14 for the purpose of adjustment to the prone person, and in the rest position.

Figure 4:
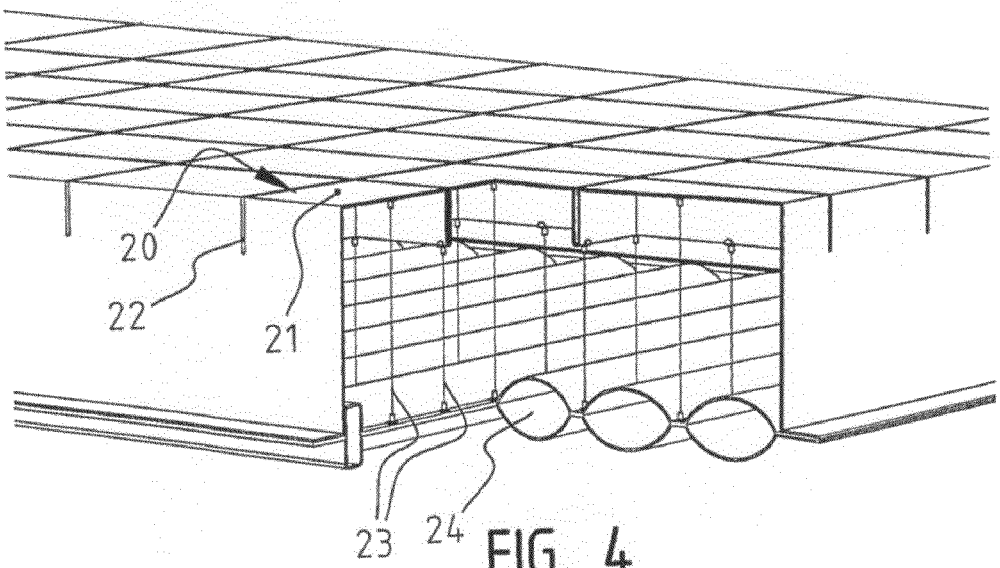
FIG. 4 shows a mattress according to the invention in another embodiment.

According to a further developed embodiment as shown in FIG. 4, upper foil 20 is formed with block forms 21 which define folds 22 between them. The upper foil is herein connected to the lower foil by thread-like connecting elements 23 instead of the above described strips 12.

The blocks with intermediate folds formed in upper foil 20 allow a relative displacement of these blocks relative to each other. Tensile stresses in the upper foil are hereby eliminated or at least considerably reduced for safeguarding the mattress. These tensile stresses can in addition also cause discomfort to a sensitive person, and the lying surface can moreover be adjusted in more subtle and fitting manner to the contour of the prone body.

Owing to the thread-like connecting elements 23 a minimal hindrance (bulges in upper foil 20) due to displacement of the block-like elements is obtained on the one hand, and a maximum free space for the granular material on the other. For the sake of completeness it is noted here that the inner space of air chamber layer 3 is shown here without granular material in order to allow the internal construction to be clearly discernible.

It can be seen that the lower foil itself consists of two foils mutually connected by longitudinal seams located at regular intervals. Such longitudinal seams can be realized as line or spot welds. Formed between these longitudinal seams are tubes 24 which impart to the mattress a certain appropriate or desired or, if necessary, basic rigidity. A base is thus as it were provided which comprises an air chamber which is per se also inflatable and has a maximized height or thickness and a corresponding air volume, whereby it is possible to bring the mattress into a desired inflated state, preferably the adjusting position (but optionally also the rest position), when it is filled with air. A pump can herein be connected to the tubes 24 only in order to increase the rigidity of the mattress, particularly in the adjusting position. With a suitably chosen degree of filling and type of filling material in the space above tubes 24 a rigidity sufficient for the adjusting position can be realized using tubes 24.

The feed and discharge of air to and from the air chamber layer for the adjustment from the rest position to the adjusting position can take place in self-evident manner with an air pump. An air accumulator with an air storage space is however preferably applied. The air transport can hereby be realized with relatively little power and, accordingly, little noise.

Figure 5B:
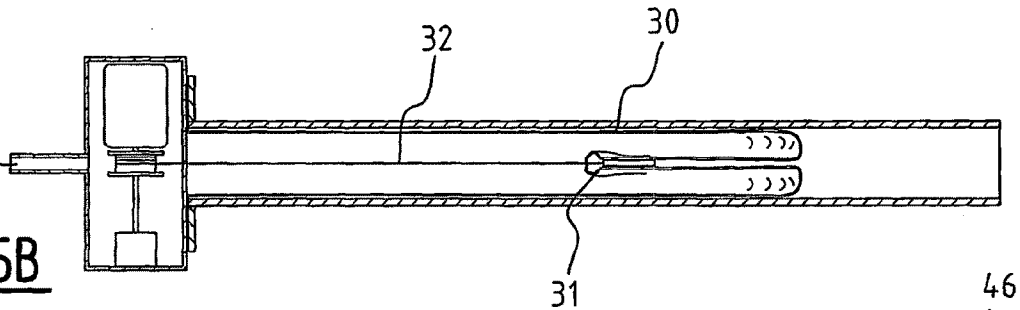

FIGS. 5A and B show a preferred embodiment of an air accumulator according to the invention. The air accumulator 28 shown in FIG. 5 comprises a rigid tube 29 inside which is received a tube 30 of flexible material, for instance rubber foil. This tube of flexible material 30 is closed at one end 31. The internal space of this flexible tube is connected to the air chamber layer via an air connection 35.

The closed end 31 of flexible tube 30 is connected by means of a cable 32 to a cable drive which comprises a reel 33 which is driven by an electric motor 34. When air now has to be fed to the air chamber layer, motor 34 is activated, whereby cable 32 is wound onto reel 33. The closed end 31 of the flexible tube is now pulled toward the end of tube 29 where the drive is situated, whereby the air is pressed out of the flexible tube via connection 35 to the air chamber layer.

When air must be discharged again in order to go from the adjusting position to the rest position, cable 32 is payed out until the situation of FIG. 5A is obtained once again.

FIG. 6 shows another embodiment variant of this air accumulator. This accumulator 36 also comprises a rigid outer tube 39 and a flexible inner tube 37. Drive 46 is positioned close to the closed end of the flexible tube and the cable is connected close to air connection 47 to a spiral spring 38 which is sufficiently strong to displace the closed end of flexible tube 37 over a significant part of the length of tube 39. When air must be displaced in order to move the mattress from the rest position to the adjusting position, cable drive 46 is payed out whereby spring 38 can pull the closed end of the inner tube toward air connection 47. In the opposite movement the drive 46 is activated so that the closed end of tube 37 then moves to the right again as seen in FIG. 6 in order to discharge air from the air chamber layer.

Yet another preferred embodiment of the air accumulator according to the invention is shown in FIG. 7. This accumulator 40 comprises an air chamber 41 which can be of flexible material and somewhat resembles an air mattress. Air chamber 41 can however also be manufactured from rigid material.

Connected to the interior of this air storage 41 is a discharge conduit 42, which is connected to the air chamber layer of the mattress according to the invention. A valve 43 is opened in order to feed air from storage 41 to the air chamber layer.

In order to discharge air again from the air chamber layer for the purpose of moving from the adjusting position to the rest position an exhaust valve 44 is opened which exhausts air to the environment.

As soon as a quantity of air has been discharged from air storage 41, an air pump 45 is activated which draws in air from the environment and presses it into the air accumulator. This pump 45 can have a small capacity since it is only necessary for sufficient pressure to be available again in air storage 41 when the adjusting means want to bring the mattress the next time from the rest position to the adjusting position.

FIG. 8 shows an embodiment with internal detection means as an alternative to the external detection means 5 for detecting movements shown in FIG. 1A. These comprise cables 52 which are connected via a coder 50 to a take-up reel 51 and which are connected to an upper foil 53 of mattress 54 in order to enable detection of movements. In response thereto the mattress 54 can be made more or less hard or rigid using pump means or exhaust means such as a valve (not shown).

FIG. 9 shows an embodiment in which lateral compartments or segments 55 of mattress 56 can be made harder and more rigid or softer and more flexible individually of the intermediate segments 57 using a manually or automatically controlled or operated pump 58. This can however also be an air discharge. Although not deemed essential, granular material can also be arranged in lateral compartments 55. Lateral compartments 55 can be provided with tubes 59 similar to tubes 24 for the purpose of realizing a basic rigidity. Pump 58 can be connected to these tubes 59 so as to adjust the basic rigidity of lateral compartments 55.

Particularly in the areas corresponding with shoulders and hips of a person using the mattress this is deemed to form a useful and practicable addition.

As addition or as alternative, laterally extending compartments can also be provided. In the degree of filling with solid, shaping (granular) material of each compartment it is thus possible to take into account the loads on the mattress, such as of a head, trunk or legs, varying in the length direction of a person.

FIGS. 10 and 11 show different views of yet another embodiment of a mattress 60 according to the present invention. The embodiment of FIGS. 10 and 11 differs in a number of respects from the embodiment of FIG. 8. FIG. 8 for instance shows that a form of detection of movement of a user can be realized with cables 52, which is not shown in FIGS. 10 and 11 but which could be present therein.

In the embodiment of a mattress 60 according to FIGS. 10 and 11 a cooling flow 61 is further initiated through mattress 60. This can also comprise a heating flow 62. Cooling flow 61 and heating flow 62 are only shown schematically and could be realized in diverse ways, for instance with conduits. A flexible hose with heat-exchanging elements thereon (optionally situated outside the mattress) can for instance be used to circulate either a cooling fluid or a heating fluid through the hose. In such an embodiment the cooling flow 61 and heating flow 62 could thus be formed as a unit. Other embodiments are also possible. Use can for instance be made of an electrical heating element as embodiment of heating flow 62. In similar manner such an embodiment can also be provided for cooling flow 61. Alternatively, it is possible to opt for free air flows through the mattress, in particular the compartments thereof. It is particularly the case in such an embodiment that, when use is made of temperature adjusting means such as cooling flow 61 and heating flow 62, a possible temperature adjustment can also be monitored or indicated with a sensor, which is then preferably located in the interior of mattress 60. This can be connected to or generate signals to a control for a user so that this latter can set the desired temperature. A sensor is not shown, nor is a control. Such aspects of this embodiment of mattress 60 can however be very readily realized by a person with ordinary skill in the art.

The embodiment of FIGS. 10 and 11 also differs in another respect from the embodiment in FIG. 8. Instead of the tubes 24 in FIG. 8, other devices 63 forming core elements are arranged in FIGS. 10 and 11. These devices 63 forming core elements can take up a desired volume in the compartments. Because the devices forming core elements per se occupy a smaller volume than whole compartments in which the individual devices 63 are arranged, these devices forming core elements can also function as fine adjustments which can be quickly enlarged or made smaller so as to enable adjustment of a desired rigidity of the whole mattress 60. In FIG. 10 mattress 60 is thus shown with the devices 63 forming core elements in small state, while in FIG. 11 the devices 63 forming core elements are shown in large state. In order to adjust the volumes taken up by devices 63 forming core elements use can be made of means other than air pressure. It is for instance possible to make use of stepping motors or other electrically driven options other than the pneumatic tubes 24 in the embodiment of FIG. 8. Devices 63 forming core elements can thus be adjusted in very fine and rapid manner to the volume they take up or are to take up, and this can contribute to the detected rigidity or hardness of the whole mattress 60, which in other embodiments is achieved in each case entirely with air, and is therefore realized in the embodiment of FIGS. 10 and 11 with an electrically energized or generally mechanical solution. Devices 63 forming core elements can bring about a kind of presetting of the rigidity or hardness of mattress 60 in the same manner as tubes 24 in FIG. 8, but can also or alternatively contribute to a very sensitive fine adjustment of the hardness or rigidity of mattress 60, and in particular the separate compartments thereof, in which a device 63 forming a core element is arranged in each case.

If the devices 63 forming core elements are designed with a stepping motor and/or a type of sensor or coder, a control circuit can be provided with which a user of mattress 60 can influence fine adjustment or presetting of the hardness or rigidity of mattress 60. An (optionally wireless) remote control can for instance be provided (not shown), which can for instance comprise a touch screen for adjustment of mattress 60 as required. Again: this can be a fine adjustment and/or presetting of the hardness or rigidity of mattress 60 which is to be detected or has been detected.

Figure 12A:
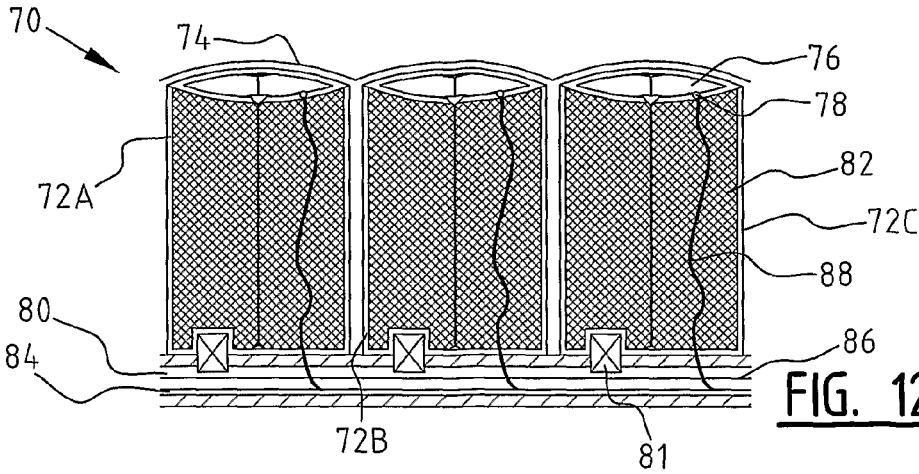
Figure 12B:
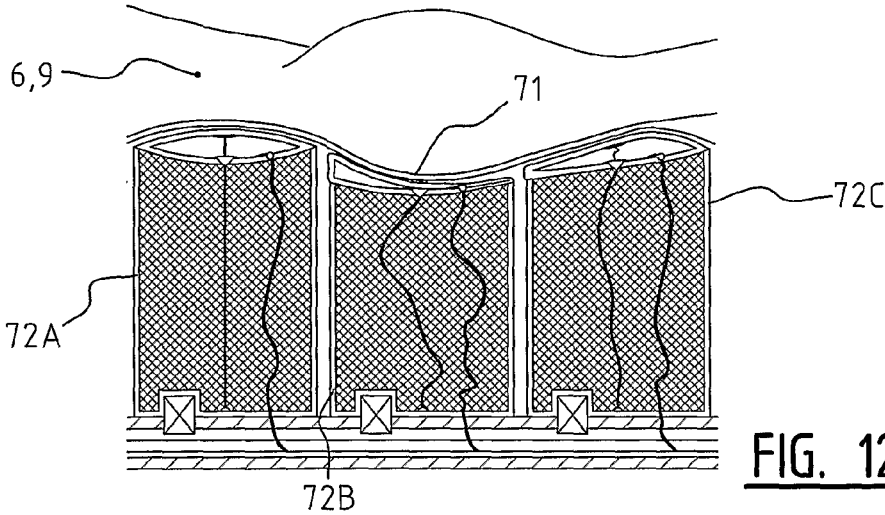
Figure 12C:
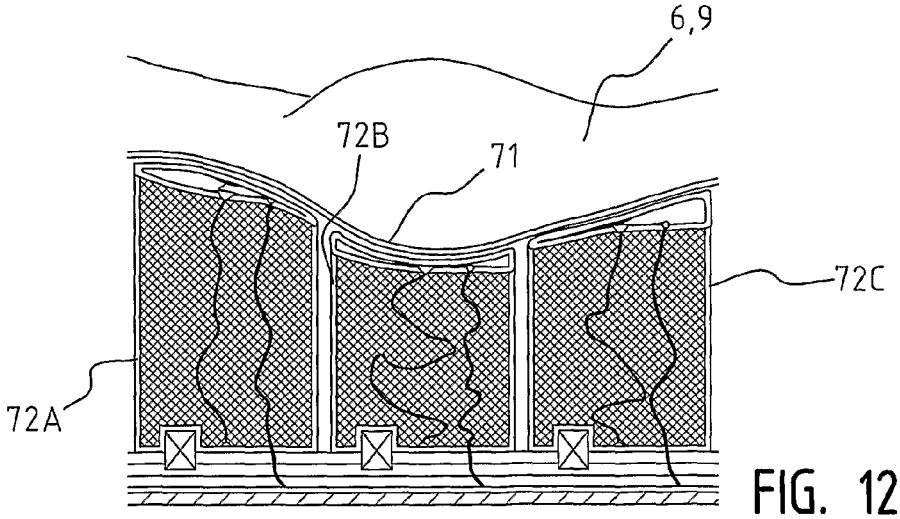

FIG. 12 shows an alternative embodiment according to the invention which can optionally be combined with above stated measures. Mattress system 70, on which a body 6, 9 with body contour 71 can be placed, comprises a set of separate segments 72 of for instance about 10 by 10 cm and 18 cm high. Each of these segments 72 is preferably individually adjustable here. 126 segments 72 are thus required for a bed of 90 by 220 cm of which, excluding head and side strips, an area remains of 70 by 180 cm. Mattress 70 is preferably provided with a cover foil 74, for instance for anti-bedsore purposes, located over segments 72. Foil 74 is for instance connected to segments 72 via a type of spot-welding. This ensures good hygiene and ease of cleaning, while due to the separate segments 72 no undesirable tensile stresses will occur because the foil can follow the deformation of segments 72. Segments 72 comprise an air cushion or air chamber 76 in which a constant pressure prevails of for instance 15 mBar. A pressure sensor 78 is incorporated in chamber 76 or on the air hose connected to chamber 76. As soon as sensor 78 measures a value above the set value of for instance 15 mBar in the sleeping position, air valve 81 is activated. An (adjustable) overpressure of for instance 40 mBar, equal to that in the bottom air chamber 80, prevails in the segments during the resetting position. After ending of the resetting position the air pressure in segments 72 and chamber 80 decreases to 15 mBar due to opening of valves 81. The first part of the contour-forming takes place due to the decrease in pressure. A first segment 72A can thus not yet be loaded (therefore a pressure in the air chamber of 5 mBar), while a second segment 72B is loaded (pressure 30 mBar) and for instance a third segment 72C is loaded to some extent (pressure 20 mBar). As soon as the reset phase is ended, an underpressure of for instance 20 mBar is applied in the bottom air chamber 80. Valves 82 hereby remain closed. The bottom air chamber 80 can be embodied as a flat chamber composed of polyester of for instance 3 cm in height, in which can be accommodated the various connections for air 84 and control 86, and conduits 88 to for instance chamber 76. Valves 82 are preferably opened and closed mechanically or electronically simultaneously as a unit during the transition from the position of FIG. 12A to that of FIG. 12B. They are however individually coupled electronically to pressure sensor 78 arranged in the relevant segment 72. It is hereby possible that, as soon as a sensor 78 records an overpressure, the respective valve is opened until the moment when a pressure of for instance 15 mBar once again prevails in the air chamber in that segment 72. The volume of second segment 72B can hereby decrease by for instance 30% and that of third segment 72C by 15%. Foam filling 82 will herein bear part of the weight. As a result of the volume decrease in segment 72B the volume of first segment 72A also becomes 5% smaller. In the position according to FIG. 12C an overpressure of up to 15 mBar prevails in all air chambers 72. This means that the counter-pressure on the body will not be higher than 15 mBar anywhere in the lying surface, even in the case of a slight change in position. This is possible because segments 72 can be individually adjusted. In the case an (adjustable) threshold value is reached, a reset procedure will once again be performed. This achieves that mattress 70 will function in more refined manner. The set upper limit, here 15 mBar, will not be exceeded anywhere in the lying surface, with a greater freedom of movement in the sleeping position. The necessary corrections are also minimized, wherein the setting values can be readily modified and therefore adapted to the user. By providing variations in setting values per segment 72, mattress 70 is very suitable as for instance anti-bedsore mattress. Following on from this, the control can be expanded with a control program in which the switching values vary during the sleep cycle depending on the stage and moment of sleep (phases of sleep, sleep rhythm and individual requirements).

After examination of the foregoing other additional and alternative embodiments lying within the scope of this invention will occur to the skilled person. Subdivisions in transverse direction relative to the longitudinal direction of the mattress can also be or have been provided in order to limit displacement of the granular material in that direction, particularly in the zones corresponding with hips and shoulders. The mattress can be bordered with edge regions, even if these were not to comply per se with the claims. The more inward-lying areas of the mattress for instance can however comply therewith. The area underneath a pillow can comprise its own control for the hardness or rigidity thereof in a manner similar to FIG. 9, 10 or 11. The same applies for the foot end of the mattress.

Many combinations and subdivisions of compartments are possible. The lateral compartments 55 shown in FIGS. 8, 9 can thus be divided into three along the length of the mattress, while the intermediate compartments can be provided in ten or more (or fewer) parts in longitudinal direction or in four or more (or fewer) parts in the width.

As addition or as alternative to shaping material, selected compartments can further comprise only respective core elements, for instance in particular in head or shoulder regions.

The invention claimed is:

1. Mattress comprising an underlayer, an air chamber layer arranged above the underlayer, characterized by solid shaping material such as granular material incorporated in the air chamber layer, and adjusting means for adjusting the amount of air in the air chamber layer between a rest position, wherein the air chamber layer is substantially filled only with the solid shaping material, and an adjusting position wherein the air chamber layer is only partially filled with solid material and further with air under a pressure, wherein the adjusting means comprise air transport means for feeding and discharging air to and from the air chamber layer, movement detection means and control means for activating the air transport means in response to the movement detection means, wherein the control means are configured such that at the beginning of a movement on the mattress, detected by the movement detection means, the control means activates the air transport means for the purpose of feeding air to the air chamber layer in order to bring the air chamber layer into the adjusting position and, at the end of the movement on the mattress, the control means activates the air transport means for the purpose of discharging air from the air chamber layer in order to set the rest position.

2. Mattress as claimed in claim 1, wherein the air transport means comprise an air accumulator connected to the air chamber layer and having an air storage space, and means for increasing and decreasing the size of the air storage space.

3. Mattress as claimed in claim 2, wherein the air accumulator has a tubular form with a tube of flexible material which is received therein and defines the air storage space and which is closed at one end and comprises displacing means engaging on this end for moving this end reciprocally in the tubular form.

4. Mattress as claimed in claim 3, wherein the displacing means comprise a cable drive.

5. Mattress as claimed in claim 1, wherein the air transport means comprise an air pocket connected via an air conduit to the air chamber layer, a small capacity air pump and valve means in the air conduit and in the air conduit leading to the outside.

6. Mattress as claimed in claim 1, wherein the solid shaping material is at least one of the materials from the group comprising: expanded polystyrene granules; latex; foam (parts or flakes); polyether and so on.

7. Mattress as claimed in claim 1, wherein the air chamber layer comprises two foils lying at a mutual distance which are connected airtightly to each other on their peripheral edges and which are mutually connected at regular intervals.

8. Mattress as claimed in claim 7, wherein the foils are mutually connected by strips provided with openings for passage of the granular material.

9. Mattress as claimed in claim 7, wherein the upper foil is formed with blocks forming folds between them.

10. Mattress as claimed in claim 7, wherein the upper foil is connected by thread-like connecting elements to the lower foil.

11. Mattress as claimed in claim 1, further comprising: at least two compartments each having its own degree of filling with the solid shaping material.

12. Mattress as claimed in claim 11, wherein the degree of filling of at least one of the compartments corresponds with an anticipated loading thereof, such as a compartment in an area for supporting a trunk, legs, a head or a side.

13. Mattress as claimed in claim 11, wherein a heating and/or a cooling is arranged in at least one of the compartments.

14. Mattress as claimed in claim 13, wherein the heating and/or cooling is provided in more than one compartment.

15. Mattress as claimed in claim 11, further comprising in at least one of the compartments a core element for creating at least a bias and/or a fine adjustment in the associated compartment.

* * * * *